US007975827B2

(12) United States Patent
Michenet

(10) Patent No.: US 7,975,827 B2
(45) Date of Patent: Jul. 12, 2011

(54) LINEAR MACHINE FOR PROCESSING PORTABLE OBJECTS AND METHOD FOR PROCESSING PORTABLE OBJECTS

(75) Inventor: Sebastien Michenet, St. Denis de I'Hotel (FR)

(73) Assignee: DataCard Corporation, Minnetonka, MN (US)

( * ) Notice: Subject to any disclaimer, the term of this patent is extended or adjusted under 35 U.S.C. 154(b) by 0 days.

(21) Appl. No.: 12/293,644

(22) PCT Filed: Feb. 22, 2007

(86) PCT No.: PCT/IB2007/000568

§ 371 (c)(1),
(2), (4) Date: Apr. 27, 2010

(87) PCT Pub. No.: WO2007/107823

PCT Pub. Date: Sep. 27, 2007

(65) Prior Publication Data

US 2010/0204827 A1 Aug. 12, 2010

(30) Foreign Application Priority Data

Mar. 22, 2006 (FR) ..... 06 02491

(51) Int. Cl.
*B65G 1/10* (2006.01)

(52) U.S. Cl. ..... 198/346.2; 198/345.1; 235/457; 414/331.01; 414/331.14; 414/331.15

(58) Field of Classification Search ..... 198/345.1, 198/346.1, 346.2; 700/229, 230; 235/457; 414/331.14–331.15, 331.01
See application file for complete search history.

(56) References Cited

U.S. PATENT DOCUMENTS

| | | | | |
|---|---|---|---|---|
| 4,373,846 | A * | 2/1983 | Charbonnet | 414/331.16 |
| 4,655,663 | A | 4/1987 | Rosati et al. | |
| 4,725,182 | A * | 2/1988 | Sakamoto et al. | 414/331.02 |
| 5,203,661 | A * | 4/1993 | Tanita et al. | 414/331.16 |
| 6,045,318 | A * | 4/2000 | Mochida et al. | 414/609 |
| 6,474,925 | B1 | 11/2002 | Ormerod et al. | |
| 6,695,205 | B1 | 2/2004 | Lundstrom et al. | |
| 7,434,675 | B1 * | 10/2008 | Rohm et al. | 198/346.2 |
| 2003/0121758 | A1 * | 7/2003 | Spejna et al. | 198/346.2 |
| 2004/0081538 | A1 * | 4/2004 | Rice et al. | 414/222.01 |

FOREIGN PATENT DOCUMENTS

| | | |
|---|---|---|
| DE | 4237041 | 3/1992 |
| FR | 2775098 | 8/1999 |
| WO | 0174697 | 3/2001 |

* cited by examiner

*Primary Examiner* — Mark A Deuble
(74) *Attorney, Agent, or Firm* — Hamre, Schumann, Mueller & Larson, P.C.

(57) ABSTRACT

A method for processing portable objects and a machine for processing portable objects including a device (1) for transferring portable objects (C), incorporating an integrated circuit and processing means consisting of at least two processing lifts (2, 2') separated by a space of a size of a portable object (C), translatory moved perpendicularly to the plane of the main surface of the portable objects (C) and sequentially on a guiding support (25) by driving and positioning means, each lift (2, 2') being formed with a parallelepipedal plate (22) provided with at least two processing devices, both lifts having determined different roles. The method consists of successively placing each portable object to be processed in contact with a processing station of the first lift and of the second lift.

10 Claims, 3 Drawing Sheets

Figure 1:
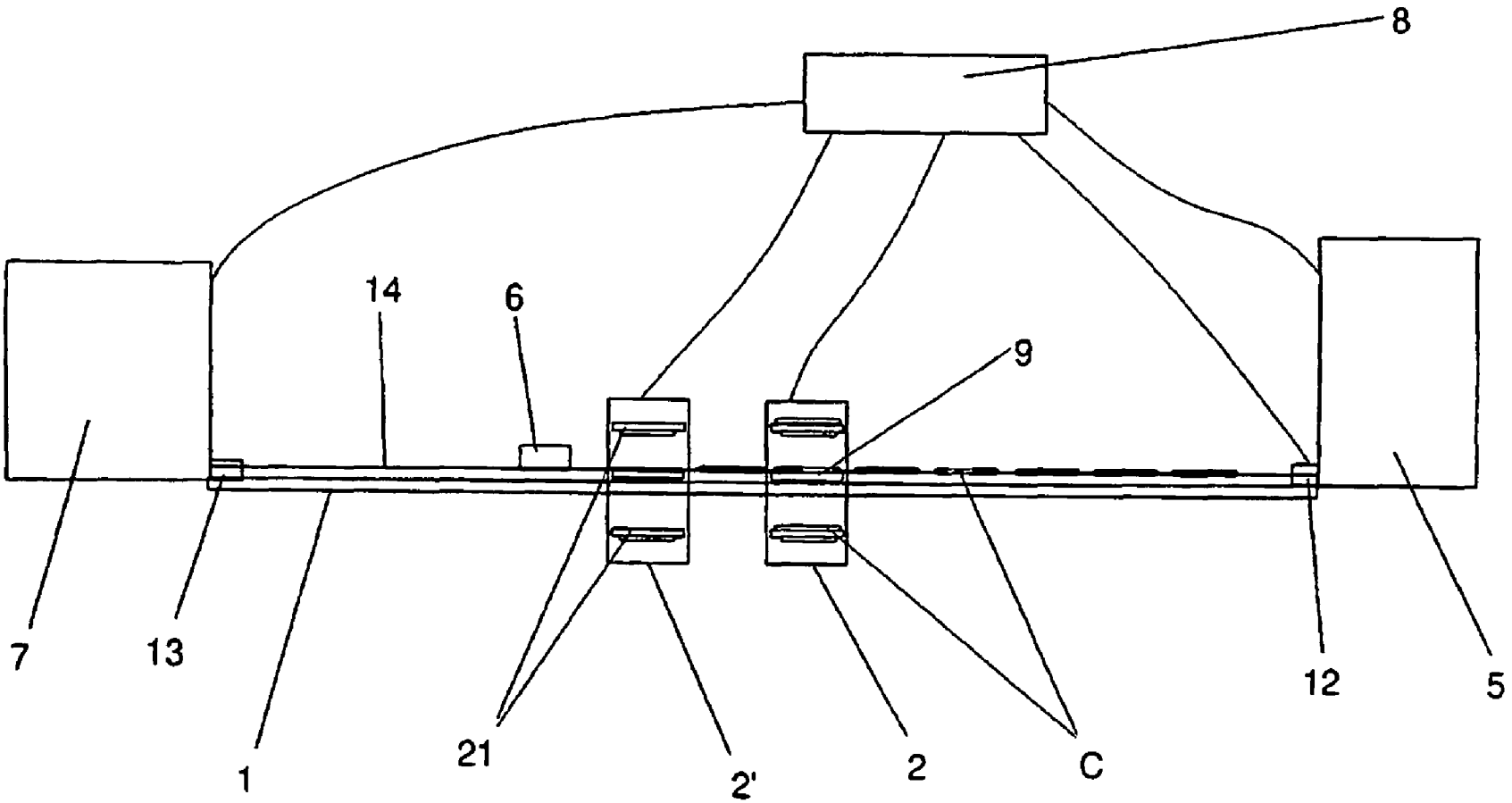

LINEAR MACHINE FOR PROCESSING PORTABLE OBJECTS AND METHOD FOR PROCESSING PORTABLE OBJECTS

RELATED APPLICATIONS

The present application is based on, and claims priority from, FR Application Number 0602491, filed Mar. 22, 2006, and PCT Application No. PCT/IB07/000568, filed Feb. 22, 2007, the disclosures of which are hereby incorporated by reference herein in their entireties.

The present invention relates to a linear machine for processing portable objects and more particularly to a linear multistation processing machine.

Linear machines for processing portable objects are already known in the prior art. These linear processing machines consist of an entry station or unstacker of portable objects, an exit station or stacker of portable objects, a horizontal linear stepper drive device for transferring portable objects, at least one workstation positioned on the linear device, at least one device for vertically displacing each of the portable objects towards the processing station when it is free, during their stepwise displacement, and a computer system. The computer system is used for checking and controlling the processing stations, the linear drive device, the vertical displacement device, the portable object unstacker and the portable object stacker.

This is the type of linear machine which is described by patent FR 2 775 098 from the same applicant. This patent therefore describes a linear customization machine, including the vertical displacement device, also called a customization lift, which is formed with a parallelepipedal plate provided with a plurality of devices for customizing portable objects. The customization devices forming workstations are therefore integrated to the lift. With the transfer device, it is thereby possible to bring the portable objects to a customization lift. When the portable objects arrive at the customization lift, the latter deals with them so that they may be processed by one of the n customization stations.

The advantage of this customization machine is that many portable objects may be processed at the same time, while allowing transfer of other objects, by means of n superimposed customization stations.

However this customization machine has a drawback resulting from the superimposition of the n stations. Indeed, the presence of n superimposed stations requires multiple vertical displacements upwards and downwards in order to load the portable objects and to unload them on the linear transfer line when they have been processed. These multiple displacements cause a loss of time. Further, superimposition of the n stations will cause the machine to occupy a lot of space in height and be more bulky.

Patents FR 2 822 989 and FR 2 822 987 propose a solution to the problem of lack of space in height by respectively describing a linear machine for processing cards, notably chip cards, and the method for handling and processing cards in this linear processing machine. This processing machine differs from the previous one by the fact that it includes n vertical displacement devices associated with n processing stations positioned on a single row beside each other, along the transfer device. Each displacement device is positioned opposite to a processing station, and has a binary configuration consisting of an upper processing portion and a lower transit is portion. The cards are then processed one after another by a single processing station according to their position on the linear transfer device. Several, cards are processed at the same time by means of different processing stations so that time may be spared and one may have a less bulky machine in height.

The drawback of this type of processing machines is that, the fact of having several processing stations side by side makes them bulky in width. Indeed, in order to compensate the reduction of the number of processing stations in height and to effectively increase the processing rates of portable objects, it is necessary to have many processing stations side by side. Further, the fact that each vertical displacement device is only associated with a single processing station prevents from having an optimum rate of the machine.

The object of the present invention is therefore to suppress one or several drawbacks of the prior art by proposing a linear machine for processing portable objects, which is not very bulky both in height and width, with which several portable objects may be processed at the same time, while providing a very high rate of processing of portable objects.

This goal is achieved with a linear processing machine, including means for processing portable objects and a device for transferring portable objects, incorporating an integrated circuit, characterized in that the processing means consist of at least two processing lifts separated on the transfer path by a space of the size of at least one portable object, the lift being translatory moved perpendicularly to the plane of the main surface of the portable objects and sequentially on a guiding support by driving and positioning means, each lift being formed with a parallelepipedal plate provided with at least two processing devices, both lifts having different roles, the first lift allows portable objects to be processed, the rank number of which on the transfer path corresponds to an odd number, the second lift allows portable objects to be processed, the rank number of which on the transfer path corresponds to an even number, wherein control and checking means provide tracking of the processing of each portable objects on each lift.

According to another feature, both processing devices are separated by a stage used for transporting portable objects, the lift being all in all formed with at least three stages.

According to another feature, with one of the three stages of each processing lifts, it is possible to receive a portable object to be transferred when the latter occupies the middle position with regards to the transfer path while the other two stages are used for the processing.

According to another feature, the guiding support consists of a parallelepipedal plate with a length equal to twice the length of the processing lift, including a slot perpendicular to the plane of the main surface of the portable objects, of two rails parallel to the slot and of a system connected to an actuator.

According to another feature, the control and checking means provide tracking of the positions occupied by the portable objects in the lifts, and the control of loading and/or unloading portable objects so that the portable objects having in the transfer path, a rank number corresponding to the parity of the lift, perform four displacements perpendicular to the plane of the main surface of the portable objects, in one of the end stages of the lift of same parity.

According to another feature, the control and checking means for loading and/or unloading portable objects are provided so that the portable objects for which the parity of the rank number is different from that of the lift, only perform two displacements perpendicular to the plane of the main surface of the portable objects, in the stage of the middle of the lift of different parity.

According to another feature, the processing devices of each lift comprise means for maintaining in position a portable object facing an electronic contact or an antenna in order to transmit information or perform actions on the portable objects, the processing devices receiving processing information adapted to the portable object identified by its rank number in the transfer path.

According to another feature, the driving and positioning means consist of a means for maintaining and sliding the lift in the rails of the guiding support, of a driving fastener securing the lift to the actuator of the guiding support, the slot of the guiding support, perpendicular to the plane of the main surface of the portable objects, forming a route for the driving fastener of the lift, the driving and positioning means allowing each stage to be stopped at the height of the portable objects and in the alignment of the device for transferring portable objects.

Another object of the invention is to propose a method for processing portable objects applying a processing machine according to the invention characterized in that it consists of:

(a) feeding the linear transfer device by means of a distribution device with a portable object to be processed at each linear displacement step of the transfer device, (b) successively placing each portable object to be processed in contact with the free processing station of the first lift upon gradual stepwise displacement of the portable objects in order to fill the three stages of the first lift, (c) replacing each portable object once it is processed, according to a defined order, on the transfer line; a new portable object to be processed being put into contact with the processing station which has just been released by the previous operation, (d) displacing towards the second lift, the replaced portable object on the transfer line, and placing it in contact with the free processing station of the second lift upon gradual stepwise displacement of the portable objects in order to fill the three stages of the second lift, all the steps are repeated until all the portable objects are processed by both lifts.

According to another feature, step b) provides processing of the portable objects in an odd position on the transfer device and step d) provides processing of the portable objects in an even position on the transfer device.

Figure 2:
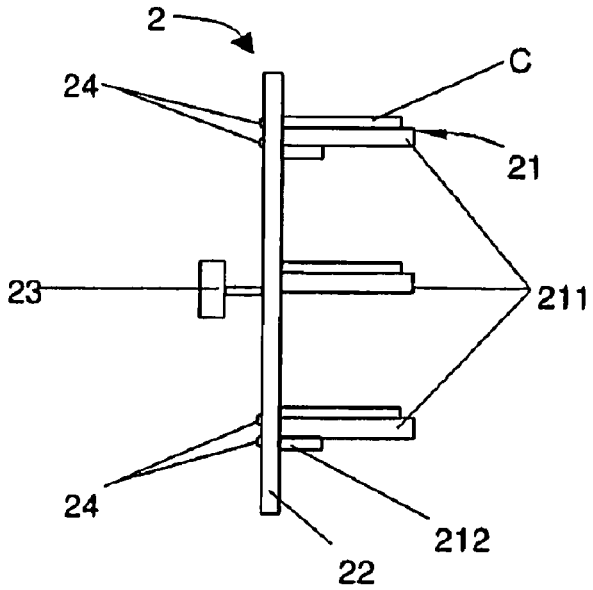
Figure 3:
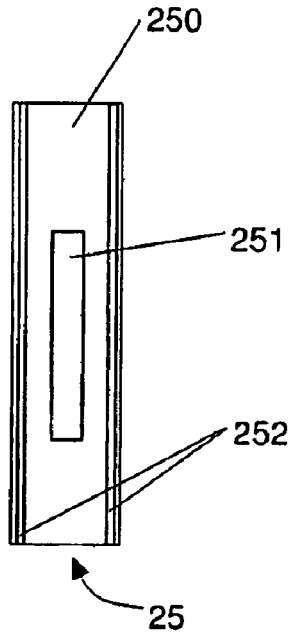
Figure 4:
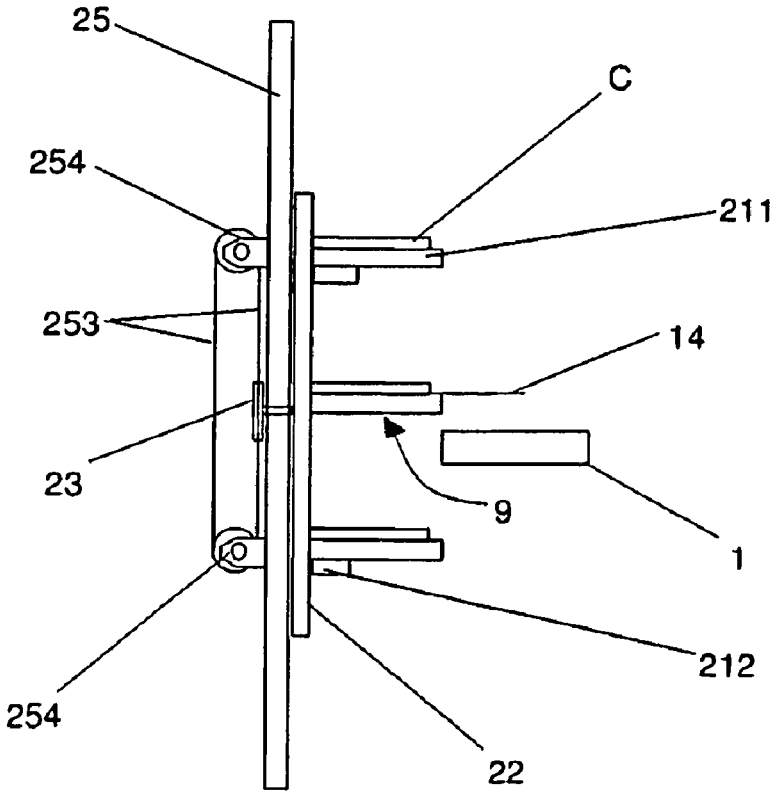
Figure 5:
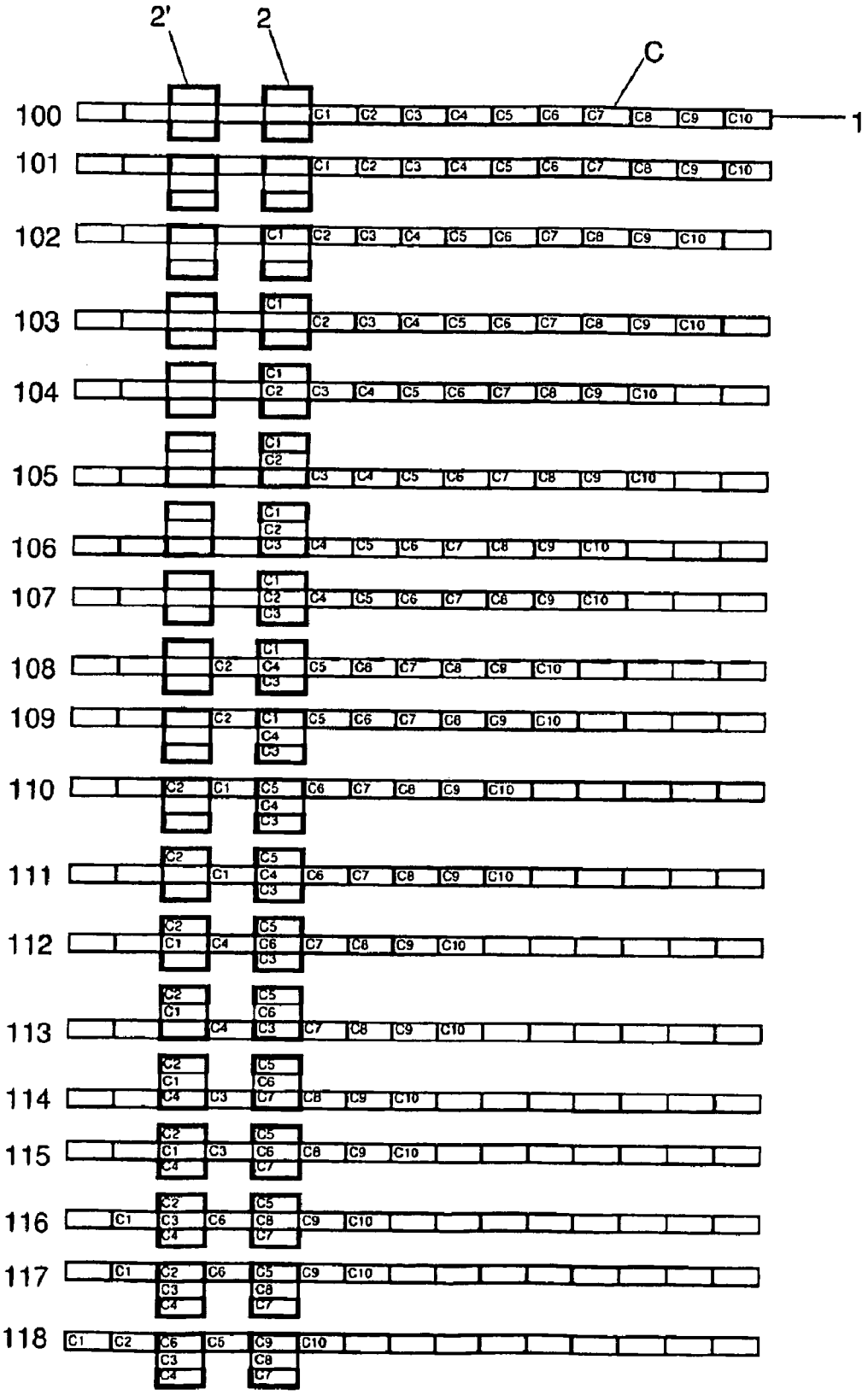

Other features and advantages of the present invention will become more clearly apparent upon reading the description hereafter, made with reference to the appended drawings, wherein:

FIG. 1 represents a schematic view of the processing machine according to the invention, FIG. 2 illustrates a profile view of a processing lift according to the invention, FIG. 3 illustrates a front view of the guiding support of the processing lift according to the invention, FIG. 4 illustrates a side view of the processing lift according to the invention, FIG. 5 is a schematization of the method according to the invention.

The invention will now be described with reference to FIGS. 1-5.

FIG. 1 illustrates a front view of the machine for processing portable objects according to the invention. The processing of the portable objects may be customization, hot pressing, or other processing operations required e.g. for using or operating portable objects, etc.

The portable objects relevant to the invention may for example be integrated circuits cards, but also any other type of objects.

The processing machine includes an unstacking station (5) wherein portable objects (C) are stored as a stack before their processing, at least two processing lifts (2, 2'), an ejection station (6) which tests the portable objects and expels faulty portable objects from the processing line, a stacker (7) of processed portable objects, and a transfer device (1). The whole of the components making up the processing machine is controlled and checked by a computer control module (8).

The transfer device (1) allows portable objects (C) to be driven away from one lift to the other. It is formed by a continuous toothed belt, forming the transfer path (14), moving between two pulleys (12, 13) driven by a motor. On this endless belt, dogs are mounted which maintain the portable objects (C) during their displacement and allow extraction and removal of the portable objects by each of the processing devices (21) of the lifts.

Both processing lifts (2, 2') of the processing machine are translated perpendicularly to the plane of the main surface of the portable objects (C) on a guiding support (25) by driving and positioning means. Both of these lifts are separated by a space of the size of a portable object (C).

As illustrated in FIG. 2, the processing lift (2, 2'), is formed with a parallelepipedal plate (22) provided on one of its faces with at least two processing devices (21) forming the processing stations. The face opposite to the one including the processing devices (21), comprises a driving fastener (23) and guiding means (24) sliding in a rail (252) illustrated in FIG. 3.

Each processing device (21) of the lift includes a fixed platform (211) integral with the plate (22) and a function head (212).

The role of the function head (212) is to process the portable object (C), and when the processing consists of customizing, the role of the function head (212) is to send the customization information to the portable object (C) to be customized.

Both processing devices (21) are positioned at each end of the processing lift. Between both devices, is found a stage (9) formed by a fixed platform (211) the role of which is to allow portable objects to be transported. The lift thus includes at least three stages, two of which are used for processing and one being used for transporting portable objects.

The guiding support (25) consists of a parallelepipedal plate (250) with a length about equal to twice the length of the processing lift (2, 2'). This plate (250) includes, at its centre, a slot (251) perpendicular to the plane of the main surface of the portable objects (C) and sufficiently wide so that the driving fastener (23) of the lift (2, 2') may penetrate therein. The length of the slot (251) is about equal to the length of the processing lift (2, 2') so that the lo lift (2, 2') may slide downwards over the whole surface of the guiding support (25). Two rails (252), parallel to the slot (251) are positioned on one face of the plate (250). On the face opposite to the face including both rails (252), two pulleys are positioned, forming a system (254) connected to an actuator (253).

When operating, the processing lift (2, 2') is translated perpendicularly to the plane of the main surface of the portable objects (C) on the guiding support (25). For this, the driving fastener (23) of the lift (2, 2') is introduced into the slot (251) of the guiding support (25), and is then firmly anchored to the actuator (253). Finally, the actuator (253) of the guiding support (25) is set into motion by an electric motor or another powering means. The actuator (253) during its displacement drives the driving fastener (23), the slot (251) forming a route for the driving fastener (23). Thus, via the actuator (253) and the driving fastener (23), the lift is driven along the guiding support. The power supply of the motor is periodically cut off when the fixed platform (211) either free or respectively occupied, of a function device (21) is at the height of the portable objects (C) located on the transfer device (1) so as to allow them to be loaded on, and respectively unloaded from the processing lift (2, 2').

The computer module includes means for checking and controlling the processing machine and receives information from different processing devices, as well as the position of different portable objects (C). These control and checking means therefore provide tracking of the position occupied by the portable objects (C) in the lifts. They control the loading and unloading of portable objects (C) so that the portable objects having in the transfer path a rank number corresponding to the parity of the lift, perform four displacements perpendicular to the plane of the main surface of the s portable objects (C), in one of the end stages of the lift of same parity. And the portable objects (C) for which the parity of the rank number is different from that of the lift only perform two displacements perpendicular to the plane of the main surface of the portable objects (C) in the stage of the middle of the lift of different parity. This is to say that the portable objects (C) in an odd to position will perform four displacements perpendicular to the plane of their main surface, in the lift in an odd position, and vice versa for the portable objects (C) in an even position and the lifts in an even position, whereas the portable objects (C) in an odd position will perform two displacements perpendicular to the plane of the main surface of the portable objects (C) in the lift in an even position, and vice versa for the portable objects (C) in an even position and the lifts in an odd position.

The processing program loaded in the memory of the computer control module (8) is aware of the types of portable objects and has an algorithm and instructions required for sending information to the processing devices (21) which corresponds to the type of portable objects identified by their rank numbers in the transfer path (14). The processing program also comprises means for selectively sending information on either one of the processing devices in order to process the portable objects (C). For this, the processing devices of each lift comprise means for maintaining in position portable objects (C) facing an electronic contact or an antenna in order to transmit information or perform actions on the portable objects (C).

Operation of the customization devices is identical with the one described in the patent application FR 2 775 098 from the same applicant, to which reference may be made for more information.

The operation, illustrated in FIG. 5, of this customization machine will now be described in detail.

The portable objects (C) are taken up (100) by the transfer device (1) so as to be brought in front of the processing lifts (2, 2").

The portable objects (C) are loaded from the transfer device (1) onto the fixed platform (211) of the processing devices by means of a card loading and unloading device already known. This device, for example with a cylinder, is able to properly position each portable object on the fixed portion (211) of the processing device (21). For more details on this card loading and unloading device, reference may be made to patent application FR 2 746 531 from the same applicant.

Upward and downward movements of both lifts are synchronized, i.e., both lifts move upwards and downwards at the same time (101) and each of their three stages is always on the same level.

When the portable object (C1), which is found in an odd position on the transfer device, for example in position 1, is loaded (102) on the third stage formed by the third fixed platform (211) of the connection device (21) of the first lift (2), the latter will move one step upwards (103), which corresponds to the distance separating two contiguous stages. The second portable object (C2), which is found in an even position, on the transfer device, is then loaded (104) on the fixed platform (211) of the second stage. The lift again moves one step upwards (105) and the third portable object (C3) is loaded (106) on the first stage of the lift. The first lift is then full. The lift will then move downwards (107) and the second portable object (C2) will then be taken up (108) by the transfer device so as to be brought towards the second lift (2') and the fourth portable object (C4) is loaded on the second stage of the first lift (2). The first lift again moves one step downwards (109), and as the operation of the lift is related, the second lift also moves one step downwards. The second portable object (C2) may then be loaded (110) on the third stage of the second lift (2'). During this time, the first portable object (C1) is taken up by the transfer device (1) and the fifth portable object (C5) is loaded on the third stage of the first lift (2). Both lifts each move one step upwards (111). The first portable object (C1) is loaded (112) on the second stage of the second lift, the fourth portable object (C4) is dealt with by the transfer device (1) and the sixth portable object (C6) is loaded on the second stage of the first lift (2).

Both lifts move one step upwards (113), the portable objects move one step forwards (114) and the fourth portable object (C4) is loaded on the second stage of the second lift. The lifts move one step downwards (115), and the portable objects move one step forwards (116). The lifts again move one step downwards (117) and the portable objects move one step forwards (118). In this way, the portable objects emerge from the second lift in the order in which they entered the first lift (2).

The steps for moving two steps forward and then for again moving two steps forward, are repeated until all the portable objects are processed (119-132). This operating mode thus allows each portable object (C) to be processed by both lifts (2, 2').

According to another embodiment of the invention, the processing device of the processing lift includes an electric test device which tests the portable objects on their arrival on the fixed platform (211). If the loaded portable object is faulty, it is directly unloaded from the lift (2, 2') onto the transfer device (1), and then expelled by the ejection station (6). If the portable object is satisfactory, the lift moves upwards and downwards so that a new portable object may be loaded on the following fixed platform.

It should be obvious to one skilled in the art, that the present invention provides embodiments under many other specific forms without departing from the field of application of the invention as claimed. Accordingly, the present embodiments should be considered as illustrative, and can be changed in the field defined by the scope of the enclosed claims, and the invention should not be limited to the details given above.

The invention claimed is:

1. A linear machine for processing portable objects, including processing means and a device for transferring portable objects incorporating an integrated circuit, the processing means including at least two processing lifts separated on a transfer path by a space of the size of at least one portable object, the lift being translatable perpendicularly to a planar main surface of the portable object and sequentially on a guiding support by driving and positioning means, each lift including a parallelepipedal plate having at least two processing devices, each of the lifts having different roles, a first of the lifts allowing processing of portable objects, the position of which on the transfer path corresponds to an even number, a second of the lifts allowing processing of portable objects, the position of which on the transfer path corresponds to an even number, and control and checking means for tracking processing of each portable object on each lift.

2. The linear machine for processing portable objects according to claim 1, wherein each of the processing devices is separated by a stage for transporting portable objects, the lift being all in all including at least three stages.

3. The linear machine for processing portable objects according to claim 2, wherein one of the three stages of each processing lift is arranged to receive a portable object to be transferred when the latter occupies the middle position with respect to the transfer path while two of the other stages are performing processing.

4. The linear machine for processing portable objects according to claim 1, wherein the guiding support includes a parallelepipedal plate with a length about equal to twice the length of the planar main surface of the portable objects, and further including two rails parallel to the slot and a system connected to an actuator.

5. The linear machine for processing portable objects according to claim 1, wherein the control and checking means is arranged for tracking positions occupied by the portable objects in the lifts, and controlling at least one of loading and unloading of the portable objects so that the portable objects having in the transfer path, a rank number corresponding to the parity of the lift can perform four displacements perpendicular to the planar main surface of the portable objects, in one of the end stages of the lift of the same parity.

6. The linear machine for processing portable objects according to claim 1, wherein the control and checking means is arranged so that the portable objects for which the parity of the rank number is different from that of the lift, only perform two displacements perpendicular to the planar main surface of the portable object in the stage of the middle of the lift of different parity.

7. The linear machine for processing portable objects according to claim 1, wherein the processing devices of each lift is arranged for maintaining in position a portable object facing an electronic contact or an antenna for transmitting information or performing actions on the portable object, the processing device being arranged for receiving the processing information being adapted to the portable object identified by its rank number in the transfer path.

8. The linear machine for processing portable objects according to claim 4, wherein the driving and positioning means is arranged for maintaining and sliding the lift in the rails of the guiding support, of a driving fastener for securing the lift to the actuator of the guiding support, the slot of the guiding support, perpendicular to the planar main surface of the portable objects, forming a route for the driving fastener of the lift, the driving and positioning means being arranged for allowing each stage to be stopped at the height of the portable object and in the alignment of the device for transferring portable objects.

9. A method of processing portable objects applying the machine for processing portable objects according to claim 1, comprising (a) feeding the linear transfer device by using a distribution device with a portable object to be processed at each linear displacement step of the transfer device, (b) successively placing each portable object to be processed in contact with the free processing station of the first lift upon gradual stepwise displacement of the portable objects so the three stages of the first lift are filled, (c) replacing each portable object once it is processed, according to a defined order, on the transfer line, so a new portable object to be processed is put into contact with the processing station which has just been released by the previous operation, (d) displacing towards the second lift, the portable object replaced on the transfer line, and placing it in contact with the free processing station of the second lift upon gradual stepwise displacement of the portable objects so the three stages of the second lift are filled, all the steps being repeated until all the portable objects are processed by both lifts.

10. The processing method of claim 9 wherein step b) causes processing of portable objects in an odd position on the transfer device and step d) causes processing of portable objects in an even position on the transfer device.

* * * * *